US005579841A

United States Patent [19]

Schneider et al.

[11] Patent Number: 5,579,841

[45] **Date of Patent: *Dec. 3, 1996**

[54] PLUGS FOR WELL LOGGING OPERATIONS

[75] Inventors: John L. Schneider, Skene; Hugo M. Barcia; Bruce C. Robinson, both of Aberdeen, all of United Kingdom

[73] Assignee: Phoenix Petroleum Services Ltd., Inverurie, United Kingdom

[ * ] Notice: The term of this patent shall not extend beyond the expiration date of Pat. No. 5,099,919.

[21] Appl. No.: 70,471

[22] PCT Filed: Dec. 2, 1991

[86] PCT No.: PCT/GB91/02127

§ 371 Date: Jun. 3, 1993

§ 102(e) Date: Jun. 3, 1993

[87] PCT Pub. No.: WO92/09784

PCT Pub. Date: Jun. 11, 1992

[30] Foreign Application Priority Data

Dec. 3, 1990 [GB] United Kingdom ..... 9026213

[51] Int. Cl.[6] ..... E21B 33/12; E21B 34/14

[52] U.S. Cl. ..... 166/135; 166/188; 166/192

[58] Field of Search ..... 166/188, 192, 166/324, 332.1, 332.4, 332.5, 332.7, 386, 135

[56] References Cited

U.S. PATENT DOCUMENTS

| | | | |
|---|---|---|---|
| 3,791,445 | 2/1974 | True | 166/72 |
| 4,164,977 | 8/1979 | Arendt et al. . | |
| 4,307,783 | 12/1981 | Lanmon, II | 166/379 |
| 4,392,377 | 7/1983 | Rankin | 73/155 |
| 4,804,042 | 2/1989 | Knight et al. | 166/184 |
| 4,950,844 | 8/1990 | Hallmark et al. | 175/59 |
| 5,054,555 | 10/1991 | Lalande et al. | 166/298 |
| 5,099,919 | 3/1992 | Schneider et al. | 166/188 |
| 5,213,159 | 5/1993 | Schneider . | |

FOREIGN PATENT DOCUMENTS

| | | |
|---|---|---|
| 9000667 | 1/1990 | WIPO . |

*Primary Examiner*—Frank Tsay
*Attorney, Agent, or Firm*—Florence U. Reynolds

[57] ABSTRACT

A hollow body is provided with a seal by which it may be sealed within a nipple profile included in a tubing string. The body allows a wireline to be passed through it while maintaining a substantial seal. During running-in lower collet fingers engage a stop ring mounted on the body. When the plug becomes seated in the nipple profile by the weight of a logging tool also suspended on the wireline, fingers are disengaged by inward movement of external collet fingers and rollers. Consequent downward movement of the fingers allows the rope socket to push them outwardly and allows the logging tool to be lowered. An equalizing sleeve can be pulled up by the socket head from the sealing position to a raised position which allows pressure equalization above and below the plug to facilitate withdrawal thereof. Profiles on the fingers act to trap the socket head should the wireline pull out or break.

10 Claims, 3 Drawing Sheets

PLUGS FOR WELL LOGGING OPERATIONS

BACKGROUND OF THE INVENTION

This invention relates to logging plugs for use in oil, gas and other wells.

To ascertain parameters of well operations such as pressure, temperature and flow rate one or more logging tools are run down the well on logging tool suspension means, for example an electrical logging cable or slick line. As many of these parameters in the perforation zone must be measured while the pressure there is different from that obtaining in the upper part of the well down which the logging tool is run, it is necessary for the suspension means to be passed through a logging plug which maintains a good, but not perfect, seal with the suspension means, and which is itself sealable within a nipple profile incorporated in production tubing, by-pass tubing or the well casing.

Considerations arising from typical employments of a conventional logging plug have been discussed in our co-pending Application PCT/GB89/00799 (WO 90/00667) which corresponds to U.S. Pat. No. 5,099,919, which is incorporated herein by reference.

It was an aim of the earlier invention to provide a logging plug which allowed the pressures obtaining above and below the plug to be equalized and thus allow withdrawal of the plug and logging tools.

According to the earlier invention there was provided a logging plug for suspension down a well, comprising a hollow body provided with sealing means by which it could be sealed within a nipple profile included in a tubing string, the body also providing or receiving means to allow suspension means to be passed therethrough while maintaining a substantial seal, and an equalizing member through which the suspension means could freely pass and which was arranged for sliding movement within said body between a first position in which communication past said sealing means was prevented and a second position in which communication past the sealing means was allowed.

Preferably the equalizing member had at least one port communicating with an axial bore through which the suspension means passed and which in the first position was closed by a sleeve forming part of the hollow body, and in the second position communicated with one or more ports formed through the wall of the hollow body.

Preferably again, the equalizing member was located at the lower end of the logging tool so that it could be displaced from the first to the second position by the upward impact of a logging hammer or of a logging tool attached to the suspension means.

A disadvantage of known logging plugs, and indeed the plug according to our earlier invention, is that the plug may have to be seated in position by the weight of a logging hammer secured to the suspension means above the plug. Securing the hammer is a time-consuming operation involving the use of expensive pressure lock apparatus.

SUMMARY OF THE INVENTION

It is an aim of the present invention to provide a logging plug which is self-seating in a nipple profile.

According to the present invention there is provided a logging plug for suspension down a well on logging tool suspension means, the plug comprising a hollow body provided with sealing means by which it may be sealed within a nipple profile included in a tubing string, the body also providing passage means to allow said suspension means to be passed therethrough while maintaining a substantial seal therewith, and engagement means which, in a running-in condition, are arranged to be engaged both by an element located on the suspension means and by the body such that, in operation, the plug becomes seated in the nipple profile by the weight of at least one logging tool also suspended on the suspension means, the suspension means also being arranged to be disengaged by release means operable by co-operation, in the seated position of the plug, with a restriction in the tubing string, to allow the suspension means to pass downwardly through the seated plug to enable the logging tool or tools to be lowered to a desired location.

Conveniently, the logging plug according to the present invention is arranged such that upward movement of said element above the point at which said equalizing member reaches its second, pressure-equalizing, position causes said member to reach a pulling-out position in which it transmits the upward force on said element to the body, enabling the plug to be withdrawn.

Preferably, the logging plug also incorporates retaining means which are caused to assume a catching condition when the equalizing member is in the pulling-out position, such that in the event of a suspension means discontinuity, and subsequent downward movement of said element, said retaining means are displaced to an engagement position in which said element is positively retained by said plug, and loss of logging tools down the well is prevented.

BRIEF DESCRIPTION OF THE DRAWINGS

Although the invention may be carried out in a variety of ways one particular embodiment thereof will now be described, by way of example, with reference to the accompanying drawings in which.

DETAILED DESCRIPTION

Figure 1:
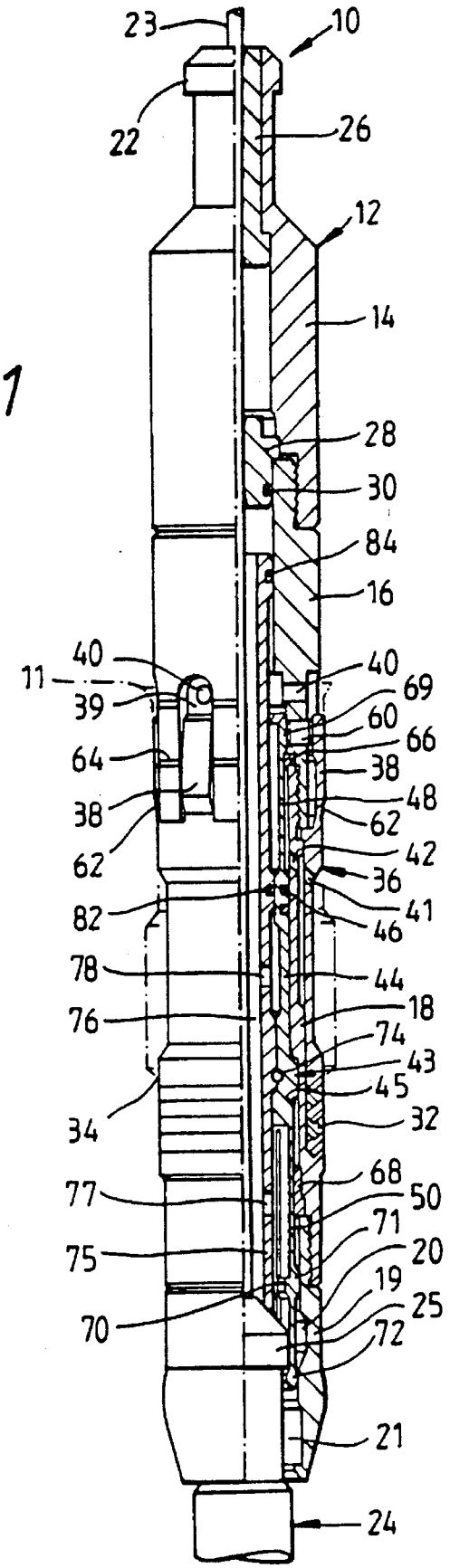
FIG. 1 is a side elevation, partially in axial section, of a self-seating logging plug according to the invention, in a running-in condition.

As seen in FIG. 1, a self-seating logging plug 10 is shown positioned in a nipple which is screwed into the bottom of a Y-tool and forms part of a by-pass tubing string. An upper nipple profile provided by the nipple is designated by the reference 11. The plug 10 comprises a hollow body 12 formed of four hollow body portions, namely a top portion 14, an upper intermediate portion 19 having annular terminal recesses 20 and 21, each of the three lower portions being screwed into the bottom of the portion immediately above. The top body portion 14 has its upper end formed to provide a fishing neck 22.

A wireline 23 passes through all the body portions 14,16, 18,19 and terminates in a rope socket 24 having a fishing neck 25 and to which one or more logging tools (not shown) are attached. An upper collar 26 and a lower collar 28 are each secured in the axial bore through the upper body 12 and have an internal diameter such that the wireline 23 may pass freely therethrough in the presence or absence of a pressure differential without causing substantial friction or wear, but on the other hand allowing very little fluid flow around the wireline 23. An O-ring 30 seals the lower collar 28 to the axial bore of the upper intermediate portion 16.

Near its lower end the lower intermediate body portion 18 is surrounded by seals 32 for sealing against a lower nipple profile 34, and by an external collet 36 which terminates at its upper end in a series of collet fingers 38, each received in a respective recess 39 provided by the turreted lower end of the upper intermediate body portion 16. A port 40 extends through the wall of the upper intermediate portion 16 at the upper end of each recess 39, and oblique aligned ports 41,42 extend through the external collet 36 and lower intermediate body portion 18, respectively.

Received for limited sliding movement within the two lower body portions 18,19 is an internal collet 43 comprising a continuous annular medial portion 44 which provides a shoulder 45 and which is sealed to the body portion 18 by O-rings 46. From the medial portion 44 there extend a series of upper internal collet fingers 48 and of lower internal collet fingers 50.

The tip of each external collet finger 38 is spaced from the corresponding tip 69 of each upper internal collet finger 48 by a roller 60 such that compression of the external collet 36 by engagement with the nipple profile 11 above the nipple 34 disengages the upper collet finger tips 69 from a stop ring 66 which is trapped between the body portions 16,18. Downward movement of the plug 10 is limited by a nipple no-go 62 which co-operates with a plug no-go 64. A stop sleeve 68 for a purpose to be described is similarly secured between the body portions 18,19; and an internal profile 70, an external profile 71, and a terminal bead 72 are formed on each of the lower internal collet fingers 50 for purposes which will subsequently become apparent.

Slidably housed within the internal collet 43 but normally located in fixed relation thereto by a shear pin 74 is an equalizing sleeve 75 which defines with the wireline 23 an annular passage 76, fluid communication across the sleeve 75 being provided by ports 77 and 78. The external surface of the sleeve is sealed to the internal collet 43 by a lower O-ring 82 and to the body portion 16 by an O-ring 84.

To run in the above-described equalizing logging plug 10 down the tubing string, the plug 10 in the condition shown in FIG. 1 is simply lowered with the bottom of the equalizing sleeve 75 resting on the rope socket 24. The engagement of the terminal beads 72 of the lower collet fingers 50 under the fishing neck 25 prevents the plug 10 from sliding up the wireline 23 when the plug 10 encounters restrictions in the tubing string.

When the plug 10 enters the top of the nipple profile 11 the external collet fingers 38 are compressed, the movement being transmitted through the rollers 60 to the upper collet fingers 48 to disengage the finger tips 69 from the stop ring 66. In the position (somewhat below the FIG. 1 position) in which the nipple no-go 62 engages the plug no-go 64 to prevent further downward movement of the body 12, the seals 32 engage the lower nipple profile 34. The internal collet 43 and equalizing sleeve 75 are now free to move relative to the body 12 and are carried down by the engagement of the fishing neck 25 with the terminal beads 72 until the shoulder 45 abuts the stop sleeve 68. In this condition, which is that shown in FIG. 2, the terminal beads 72 of the lower collet fingers 50 are free to expand into the terminal recess 21, releasing the fishing neck 25; the rope socket 24 is thus free to be lowered downhole, until the suspended logging tool is in its desired operational location.

During the production of the well a negligible quantity of well fluid will flow between the collars 26 and 28, and the wireline 23, and through the annular passage 76 to be recirculated; a seal with the wireline 23 is thus established in the by-pass tubing string while still allowing passage of the wireline 23.

Figure 2:
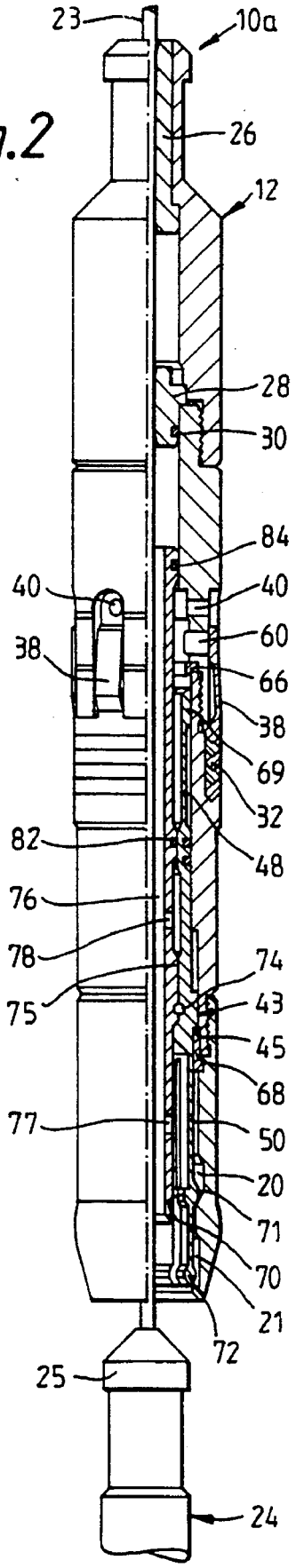
FIGS. 2 to 5 are each an elevation, similar to that of FIG. 1, showing a modification of the plug in, respectively, a releasing condition, an equalizing condition, a pulling-out condition and a wireline-failure condition.

When the plug **10*a* is in the closed condition shown in FIG. 2 there is no communication from the ports 40 through the body down past the seals 32 to the bottom of the plug 10*a*: as will be seen the O-ring 84 blocks communication to the upper end of the annular passage 76, and the O-ring 82 to the lower end. The plug 10*a* thus effectively seals across the nipple profile 34**.

If the weight of the logging tools is insufficient to move the internal collet 43 down to the FIG. 2 position or if the lower internal collet fingers 50 release the fishing neck 25 before the internal collet shoulder 45 abuts the stop sleeve 68, the pump discharge pressure and/or hydrostatic pressure ensures that the internal collet 43 is correctly positioned to admit the re-entrant fishing neck 25, i.e., with the terminal beads 72 in the recess 21 as shown in FIG. 2.

After pumping has ceased there may still be a considerable downward force on the plug **10*a* as explained in U.S. Pat. No. 5,099,919 usually rendering it operationally impossible to pull the plug 10*a* out of the lower nipple profile 34, and it is therefore necessary to equalize the pressure differential from above to below the plug 10*a***, which is accomplished as follows.

Figure 3:
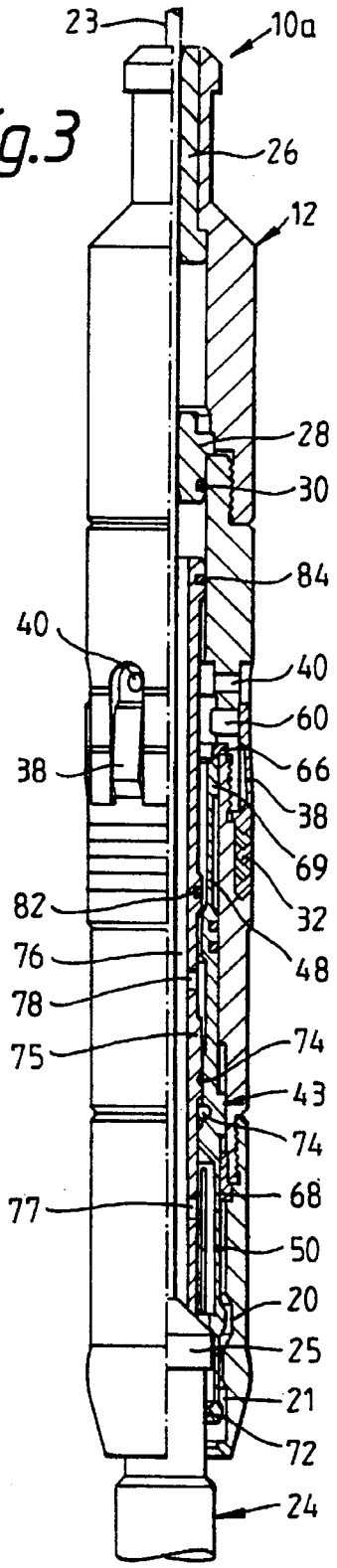

By pulling on the wireline 23 the socket head 24 is caused to re-enter the mouth of the body portion 19, passing the terminal beads 72 on the lower internal collet fingers 50 which are displaced into the recess 21. The continued ascent of the socket fishing neck 25 then moves the equalizing sleeve 75 upwards, together with the internal collet 43, until further upward movement thereof is prevented by engagement of the tips 69 of the upper internal collet fingers 48 with the stop ring 66, at which point the shear pin 74 is broken. The upward movement of the equalizing sleeve 75 is continued until the socket fishing neck 25 abuts the lower shoulder the internal profile 70, as shown in FIG. 3. In this equalizing condition the lower O-ring 82 is displaced from its seating surface on the internal collet 43, and communication across the plug **10*a* is achieved via the annular passage 76, ports 78, the annular passage between the equalizing sleeve 75 and internal collet 43, and the ports 40**.

Figure 4:
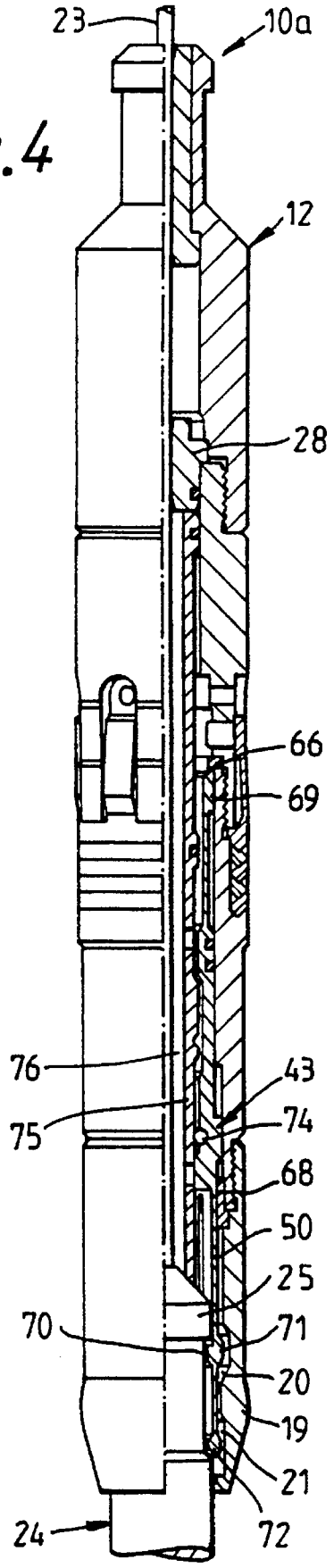

Continued pulling on the wireline 23 causes the fishing neck 25 to be pulled past the internal profile 70 on the lower internal collet fingers 50 which are free to be moved outwardly by virtue of the beads 72 and external profile 71 being opposite the recesses 20 and 21 respectively, the fishing neck 25 carrying with it the equalizing sleeve 75 until its upper end abuts the collar 28 as shown in FIG. 4, thus enabling the plug 10 to be returned to surface by pulling on the wireline 23.

Figure 5:
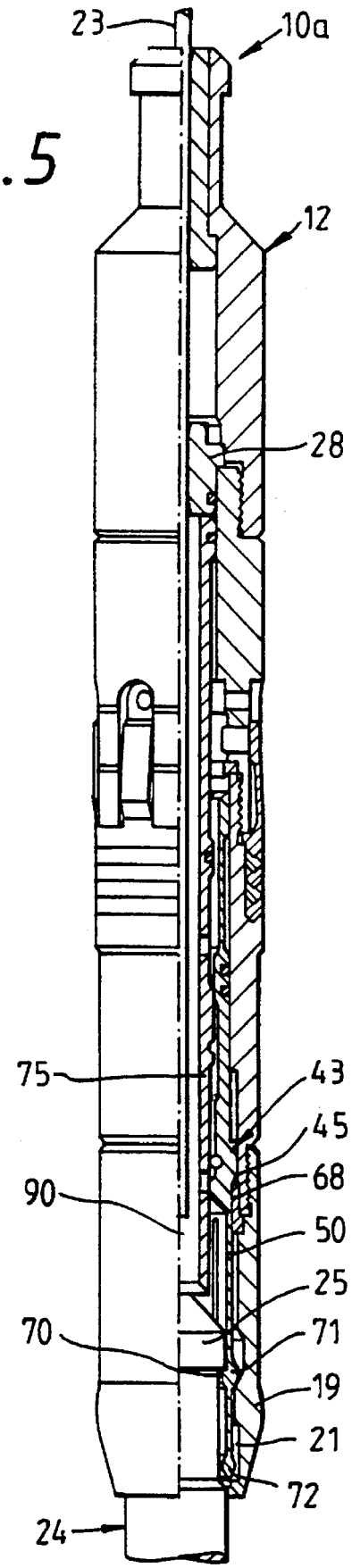

It will be noted that in the FIG. 4 condition the upper shoulders of the internal profiles 70 on the internal collet fingers 50 are positioned just beneath the fishing neck 25. Should pulling on the wireline 23 be unsuccessful in unseating the logging plug 10 from the nipple 34 the wireline 23 is designed to pull out of the rope socket, as shown in FIG. 5, at 90, which is a pre-determined point of weakness. Thus freed, the weight of the logging tools will carry the rope socket 24 downwards taking with it the internal collet 43 until the external profiles 71 on the lower fingers of the latter abut the lower shoulder of the recess 20 in the lowermost body portion 19, securely trapping the fishing neck 25 above the internal profiles 70, and preventing the logging tools from being lost downhole. It will be noted that in this condition the shoulder 45 again abuts the stop sleeve 18.

The logging plug 10*a* may then be retrieved, together with the logging tools, using stronger fishing equipment.

It will be appreciated that the above-described operation of the collet fingers 38 to release the logging tool relative to the plug 10 is "selective" with regard to position in that release will only occur when all the fingers 38 are compressed by entry into the upper nipple profile 11; release of the logging tool does not occur if, for example, one or two fingers 38 are compressed by encountering an obstacle in the tubing string when the plug 10 is being lowered downhole.

It will be further appreciated that the logging plug 10*a* shown in FIGS. 2 to 5 is a slight modification of the plug 10 shown in FIG. 1. The plug 10 is particularly applicable to being employed with the multi-sensor arrangements described in our co-pending Application No. PCT/GB90/00482 (WO 90/12196), corresponding to U.S. Pat. No. 5,213,159 and the modification 10*a* differs only in the location of the seals 32 and the omission of the ports 41,42 which are necessary to permit a fluid path into the multi-sensor valve.

We claim:

1. A logging plug for suspension down a well on logging tool suspension means, the plug comprising a hollow body provided with sealing means by which it may be sealed within a nipple profile included in a tubing string, said hollow body providing passage means to allow said suspension means to be passed therethrough while maintaining a substantial seal therewith, and engagement means, which, in a running-in condition, are arranged to be engaged both by fishing means located on the suspension means and by the body such that, in operation the plug becomes seated in the nipple profile by the weight of at least one logging tool also suspended on the suspension means, the suspension means also being arranged to be disengaged by release means co-operating, in the seated position of the plug, with a restriction in the tubing string to allow the suspension means to pass downwardly through the seated plug to enable the logging tool or tools to be lowered to a desired location.

2. A logging plug as claimed in claim 1 and additionally comprising an equalizing member through which the suspension means may freely pass and which is arranged for sliding movement within said body between a first position in which fluid communication from above said body past said sealing means to below said body is prevented and a second position in which such communication past the sealing means is allowed.

3. A logging plug as claimed in claim 2, in which the engagement means provide an annular sealing surface to which the equalizing member is arranged to be sealed in said first position.

4. A logging plug as claimed in claim 2 arranged such that upward movement of said fishing means above a point at which said equalizing member reaches its second position causes said member to reach a pulling-out position in which it transmits the upward force on said fishing means to the body, enabling the plug to be withdrawn.

5. A logging plug as claimed in claim 1, in which the release means comprise a number of annularly-disposed external collet fingers arranged to be displaced inwardly by engagement with said restriction in the tubing string to allow the engagement means to assume a tool lowering position.

6. A logging plug as claimed in claim 5, in which the engagement means comprise a number of internal collet fingers corresponding to the number of external collet fingers, each arranged, in the running-in condition, to engage a surface of the body and to be disengaged therefrom by inward displacement of an external collet finger.

7. A logging plug as claimed in claim 5, in which the engagement means comprise a number of resilient, axially-extending fingers each provided with an internal camming surface, which, in the running-in condition, engages said fishing means, and also with an external abutment surface, which, in the running-in condition, is arranged to abut the body to maintain the engagement of the camming surface with said fishing means, and in the tool lowering position is received in a recess in the body to permit the fingers to be splayed by camming action and thus allow downward movement of said fishing means.

8. A logging plug as claimed in claim 2, and additionally comprising retaining means which are caused to assume a catching condition when the equalizing member is in the pulling-out position, such that, in the event of a break in the suspension means and subsequent downward movement of said fishing means, said retaining means are displaced to an engagement position in which said fishing means are positively retained by said plug, and loss of logging tools down the well is prevented.

9. A logging plug as claimed in claim 8, in which the retaining means are constituted by an abutment face formed internally on at least one finger, and by co-operating formations on the fingers and body arranged to maintain the abutment face in engagement with said fishing means.

10. A logging plug as claimed in claim 2 in which the body includes an internal annular formation arranged to be engaged by the engagement means in the running-in condition and act as a stop member for the engagement means to allow relative upward movement of the equalizing member to said second position.

* * * * *